US006072172A

United States Patent [19]

Duggan et al.

[11] Patent Number: 6,072,172

[45] Date of Patent: Jun. 6, 2000

[54] METHOD AND APPARATUS FOR DETECTING PACKAGES IN CARTON

[75] Inventors: Robert G. Duggan, Kilkenny; Allen A. Treacy, Waterford, both of Ireland

[73] Assignee: Bausch & Lomb Incorporated, Rochester, N.Y.

[21] Appl. No.: 08/996,129

[22] Filed: Dec. 22, 1997

[51] Int. Cl.[7] ..... B65B 57/00

[52] U.S. Cl. ..... 250/221; 53/53; 53/57; 53/493; 53/505; 382/143

[58] Field of Search ..... 250/221; 53/53–58, 53/493, 494, 498, 499, 505, 506, 75, 76; 382/143

[56] References Cited

U.S. PATENT DOCUMENTS

| | | | |
|---|---|---|---|
| 3,572,502 | 3/1971 | Quinn et al. | 209/549 |
| 5,027,577 | 7/1991 | Creswick | 53/53 |
| 5,568,715 | 10/1996 | Ebel et al. | 53/54 |
| 5,577,386 | 11/1996 | Abrams et al. | 53/425 |
| 5,640,464 | 6/1997 | Ebel et al. | 382/143 |
| 5,722,536 | 3/1998 | Pierce et al. | 206/5.1 |
| 5,820,232 | 11/1998 | Takahashi | 53/499 |

FOREIGN PATENT DOCUMENTS

| | | |
|---|---|---|
| 0685734 | 12/1995 | European Pat. Off. . |
| 2323639 | 1/1975 | Germany . |
| WO 96/14943 | 5/1996 | WIPO . |

*Primary Examiner*—Edward P. Westin
*Assistant Examiner*—Thanh X. Luu
*Attorney, Agent, or Firm*—John E. Thomas

[57] ABSTRACT

A method and apparatus for confirming the presence of contact lens packages in a secondary carton is disclosed, where a sensor that detects the presence or absence of metallic lidstock of the packages through the secondary carton.

8 Claims, 4 Drawing Sheets

METHOD AND APPARATUS FOR DETECTING PACKAGES IN CARTON

BACKGROUND OF THE INVENTION

This invention relates to a method and apparatus for confirming the presence of contact lens packages in a secondary carton. The contact lens packages are designed to contain a contact lens therein and are enclosed with metallic lidstock.

A conventional manner of packaging contact lenses is in so-called "blister packages". Such packages include a recess designed to hold an individual lens, usually in a saline solution in the case of soft hydrogel lenses. The packages are then enclosed and sealed with a lidstock, the lidstock conventionally being a metallic laminate such as a laminate including an aluminum layer, that can withstand post-packaging heat sterilization conditions. Frequently, multiple blister packages of contact lenses are then enclosed in a secondary carton which conventionally has the form of a paperboard box designed to hold a predetermined number of blister packages in a predetermined arrangement.

Automation offers increased speed and less human handling in packaging products such as contact lens blister packages in a secondary carton. However, a drawback is that errors in automated packaging operations may more easily go undetected. The present invention provides a method and apparatus that can confirm that the proper number and arrangement of contact lens packages are included in secondary packaging.

SUMMARY OF THE INVENTION

The invention provides a method for confirming the presence of a contact lens package, containing a contact lens therein and enclosed with metallic lidstock, in a secondary carton. The method involves aligning the secondary carton for holding the packages with a sensor that detects the presence or absence of the metallic lidstock through the secondary carton. According to preferred embodiments, an individual sensor is provided for each respective package position in the secondary carton. The method is suitable for cartons not only designed to a single layer of packages, but also cartons designed to hold at least first and second layers of packages, where a first sensor is aligned with package positions corresponding to the first layer of packages and a second sensor is aligned with package positions corresponding to the bottom layer of packages. The invention further relates to an apparatus for carrying out the method.

BRIEF DESCRIPTION OF THE DRAWING FIGURES

DETAILED DESCRIPTION OF PREFERRED EMBODIMENTS

Figure 1:
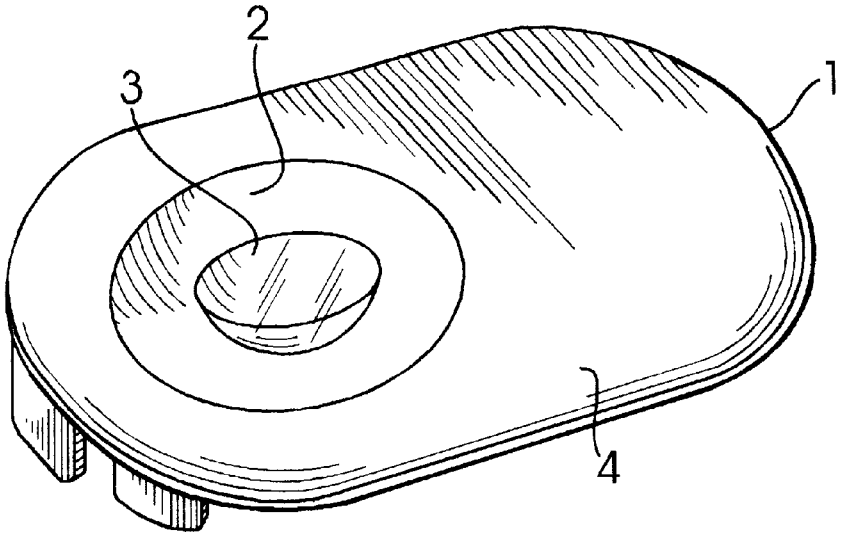
FIG. 1 is a perspective view of a contact lens blister package.
Figure 2:
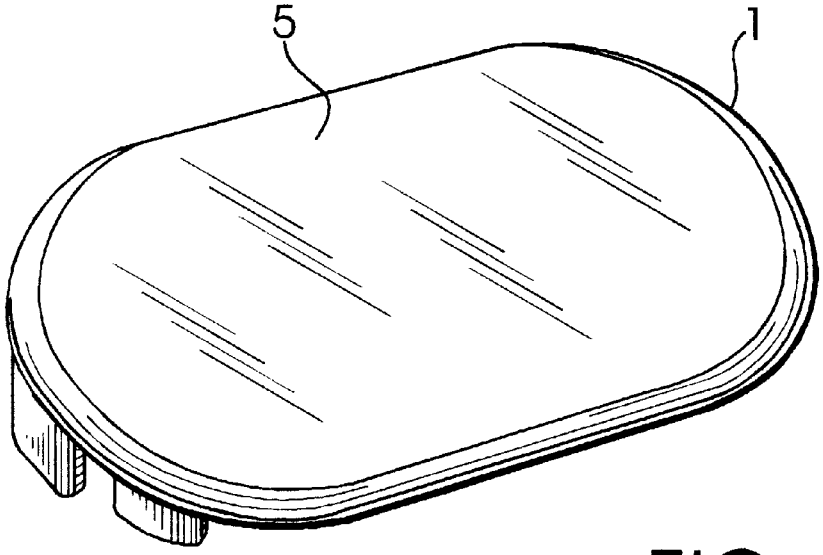
FIG. 2 is a perspective view of the blister package of FIG. 1 with a metallic lidstock in place.

FIGS. 1 and 2 illustrate a blister package for contact lenses. As seen in FIG. 1, blister package 1 includes recess

2 for holding an individual contact lens 3. Conventionally, recess 2 will also contain saline solution in the case of the contact lens being a soft hydrogel contact lens. Recess 2 terminates at surface 4. As seen in FIG. 2, metallic lidstock 5, such as a laminate including an aluminum layer, is sealed to surface 4 so as to sealingly encase recess 2 and enclose package 1. A metallic lidstock is conventionally used to enclose package 1 since such packages containing a contact lens are generally sterilized with heat and the metallic lidstock is able to withstand sterilization conditions and handling of the package.

Figure 3:
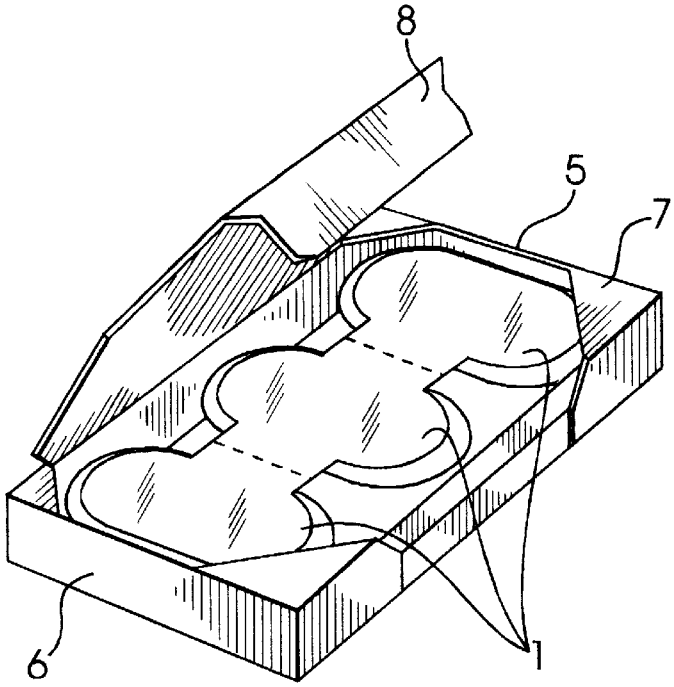
FIG. 3 is a perspective view of a secondary carton containing blister packages of FIGS. 1 and 2.

FIG. 3 illustrates secondary carton 7 for holding multiple blister packages 1. In FIG. 3, flap 8 of carton 7 is in its open position for illustrative purposes. For the illustrated embodiment, three packages are present as a top layer, and three packages (not visible in FIG. 3) are present as a bottom layer below the top layer. When flap 8 is closed, flap 8 is positioned adjacent the label and lidstock of the top layer of packages, and the label and lidstock of the bottom layer of packages is adjacent to the bottom of the carton. Accordingly, secondary carton 7 is designed to hold a predetermined number of contact lens packages (six for the illustrated embodiment) in a predetermined arrangement (two layers of three packages for the illustrated embodiment). It understood, however, that the invention is applicable to blister packages designed to hold only one layer of packages and other predetermined numbers and arrangements of packages. Regardless of the number or arrangement of packages, it will be appreciated that secondary cartons are designed to hold a certain number of packages, and when the carton is properly filled, one would know the predetermined positions of all packages. The secondary carton is generally constructed of a material such as paperboard. The blister packages in FIG. 3 further include a separate printed label adhered to the individual sections of metallic lidstock 5, but again, the specific types of blister packages or secondary cartons are not critical to the invention.

An occasional problem with automated handling of such packages is that the secondary carton may be filled with less than the predetermined number of packages.

Figure 4:
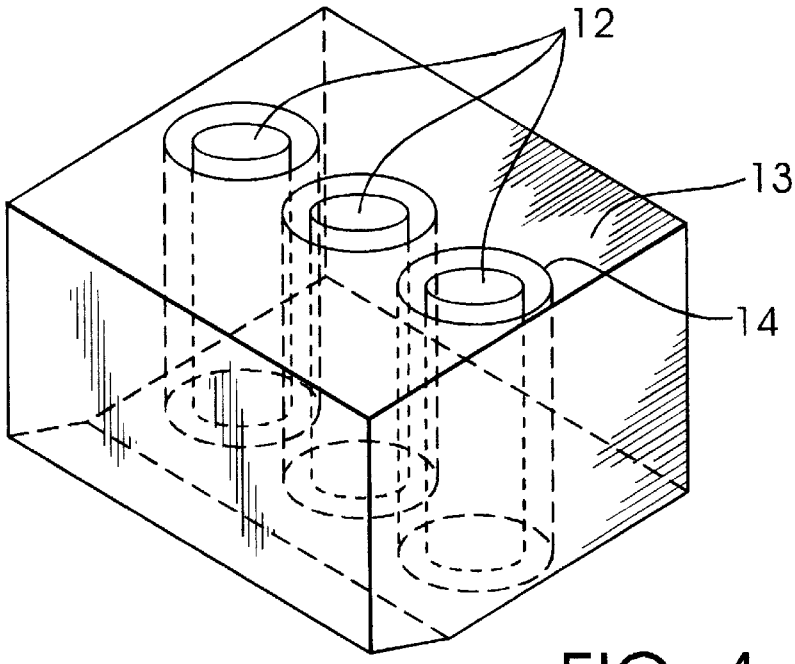
FIG. 4 is a perspective view of a first set of sensors.
Figure 5:
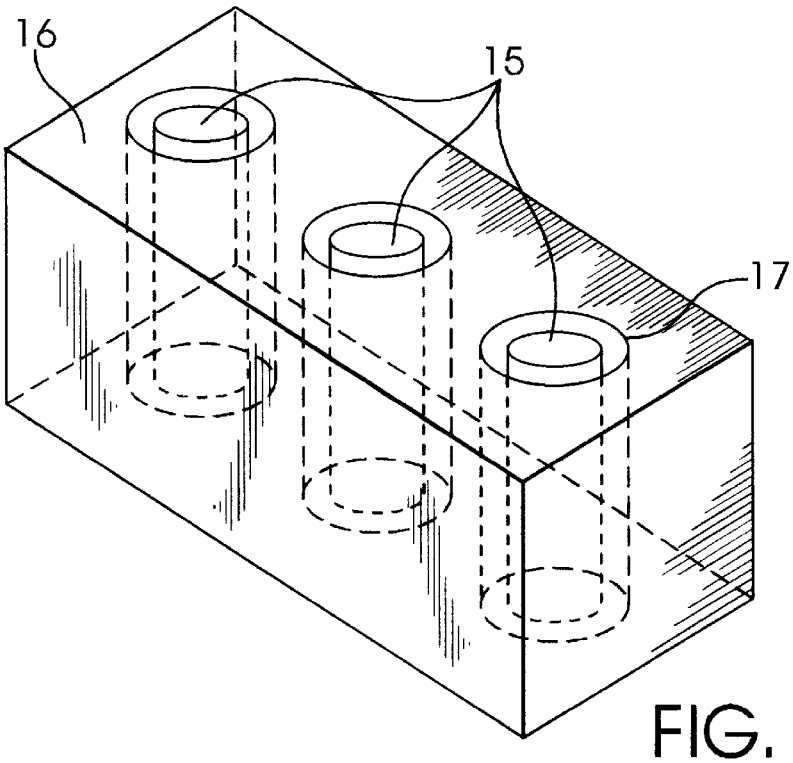
FIG. 5 is a perspective view of a second set of sensors.
Figure 6:
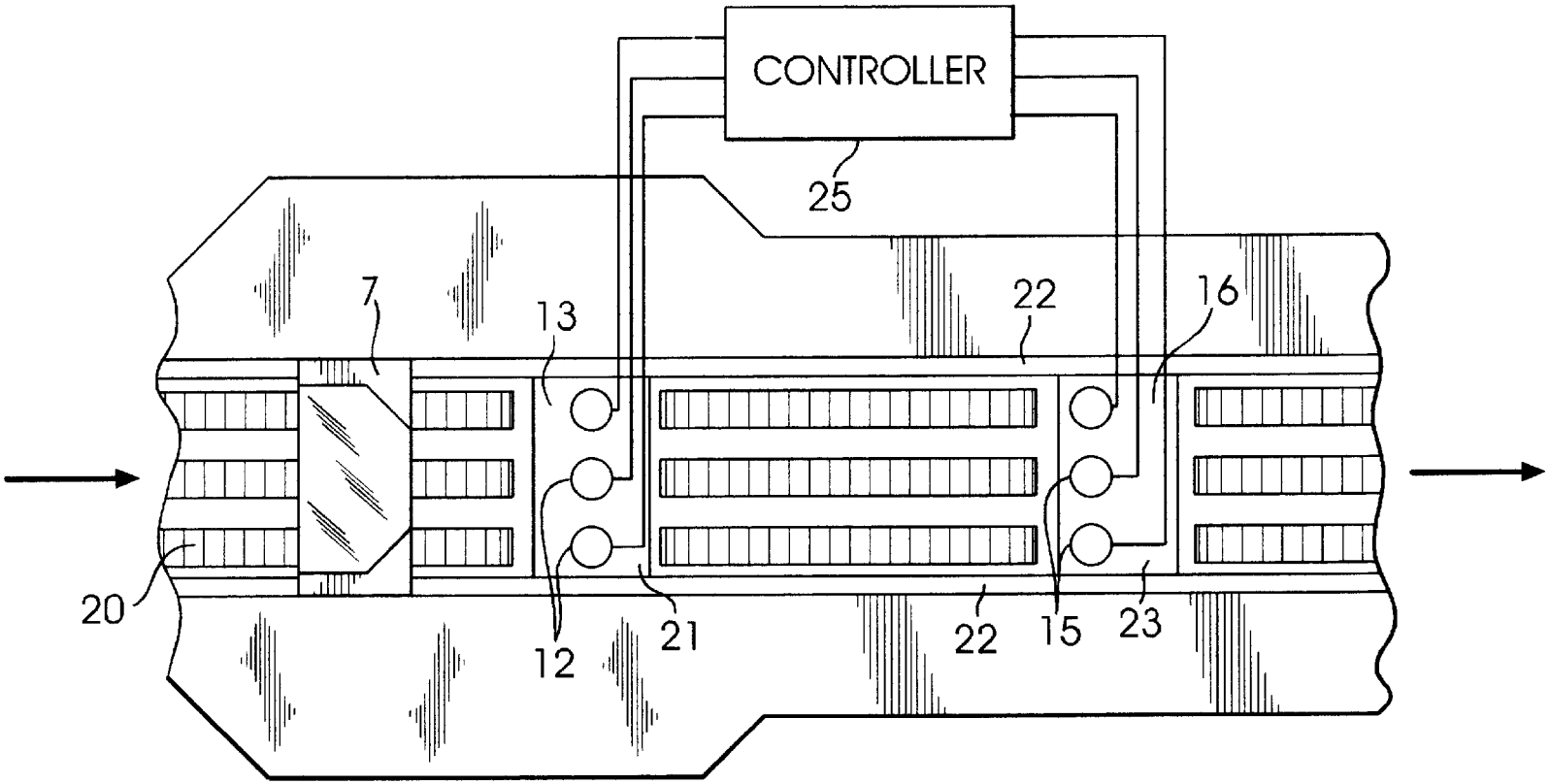
FIG. 6 is a top elevational view of an apparatus incorporating the sensors of FIGS. 4 and 5.

FIGS. 4 to 6 illustrate schematically an apparatus for confirming the presence of contact lens packages in a secondary container. The apparatus includes conveyor 20 for transporting cartons 7 (flap 8 of carton 7 in FIG. 6 being in its closed position.) Conveyor 20 transports the secondary cartons to a first station 21 that includes the set of sensors 12 shown in FIG. 4. Conveyor 20 can be provided with guide rails 22 that align with ends 5,6 of carton 7 to keep the carton in a guided position during transport along the conveyor.

As shown in FIG. 4, sensors 12 are arranged in block 13 which can be made of a plastic material such as nylon, whereby sensors 12 are mounted in bores 14 in block 13. At station 21, sensors 12 are arranged above conveyor 20, in a manner that when a carton reaches the proper position at station 21, block 13 with sensors 12 is positioned closely to the carton top, with sensors 12 being in alignment with the three package positions in the top layer. For the illustrated embodiment, three sensors are provided at station 21 corresponding to the three package positions in the top layer of packages in carton 7, each of sensors 12 being aligned with a respective package position in the top layer.

For the illustrated embodiment sensors 12 include an inductive productivity sensor that is able to detect metal. Such sensors are commercially available (such as available under the Omron tradename from Omron Electronics Ltd., London, United Kingdom). Sensors 12 are connected to controller 25 programmed in a manner that if one of sensors 12 does not render a predetermined reading (i.e., does not detect the presence of metallic lidstock through the top surface of carton 7), an alarm can be sounded to alert an operator.

In the case where the secondary carton includes a second layer of package positions, as in the described embodiment, after sensor readings are taken at first station 21, carton 7 is transported downstream to second station 23. Station 23 includes sensors 15 shown in FIG. 5, which are contained in bores 17 of block 16 and generally correspond in construction to sensors 12. Sensors 15 are arranged below the conveyor so that when a carton reaches this station sensors 15 are positioned closely to the bottom surface of carton 7, in alignment with the three package positions in the bottom layer. Again, sensors 15 are connected to controller 25 and if one of sensors 15 does not render a predetermined reading (i.e., does not detect the presence of metallic lidstock through the bottom surface of the carton), an alarm is sounded.

When the secondary carton includes more than one layer of package positions, as in the illustrated embodiment, the sensitivity of the sensors can be preadjusted so that individual sensors are not overly sensitive. For example, if a package is missing from the top layer when at first station 21, the sensitivity of sensors 12 is preadjusted so that the sensor does not detect the metallic lidstock on a package immediately below the intended package position and thereby render a "false positive" reading. Adjustments can also be made to sensors 15 so that the sensor does not detect the metallic lidstock on a package immediately above the intended package position when a package is missing from the bottom layer.

Tests have verified that the described embodiment reliably detects missing packages through the secondary carton without rendering false positive readings.

Many other modifications and variations of the present invention will be evident to the skilled practitioner. As one example, the carton may include only a single layer of packages whereby it is unnecessary to include a second set of sensors. As another example, a single sensor could be provided to detect multiple package positions so long as it and the carton are movable with respect to each other such that the sensor is alignable with each respective package position in the carton.

Figure 7:
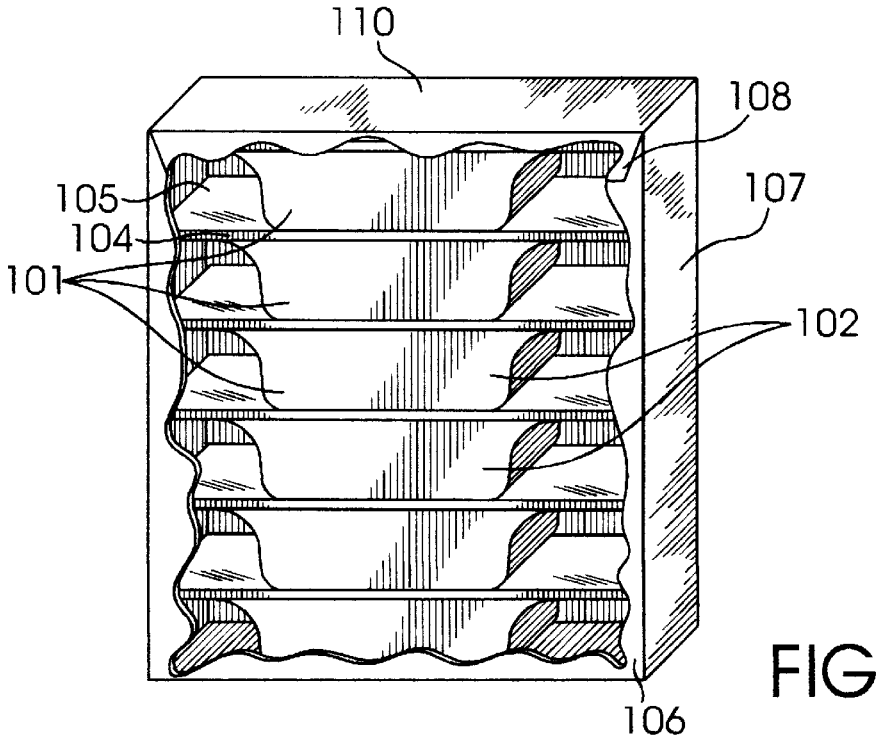
FIG. 7 is a perspective view of another arrangement of contact lens packages and carton applicable to this invention.

As another example, FIG. 7 illustrates other types of blister packages and secondary carton. Each of blister packages 101 includes a recess 102 for holding an individual contact lens and optionally a saline solution, with metallic lidstock 105 sealed to an upper surface 104 of the packages to sealingly encase each recess 102. Secondary carton 107 (with its front 106 and flap 108 partially cut-away in FIG. 7) is sized to hold six blister packages in a vertically stacked arrangement. Accordingly, if one or more of the blister packages are missing from carton 107, there will be a gap at the top of the carton when it is positioned in the upright position shown in FIG. 7 (i.e., the top package position of the carton will be empty). By positioning the carton below a sensor such that top surface 110 is closely positioned to the sensor, and preadjusting the sensor's sensitivity accordingly, the sensor can confirm the presence of absence of lidstock at this top package position.

It is therefore understood that, within the scope of the claims, the present invention is not limited to the described preferred embodiments and can be practiced other than as herein specifically described.

We claim:

1. Amethod for confirming the presence of contact lens packages, each of the packages containing a contact lens therein and enclosed with metalluc lidstock, said method comprising:

adding a bottom layer of said packages to a secondary carton, and adding a top layer of said packagesto a secondary carton, such that the top layer is arranged above the bottom layer, and each of the top and bottom layers includes a predetermined number and arrangement of package positions;

transporting the secondary carton to a first station that includes first sensors arranged above the secondary carton and transporting the secondary carton to a second station that includes second sensors arranged below the secondary carton, wherein when the secondary carton is at the first station, an individual sensor is aligned above each of the package positions in the top layer, and when the secondary carton is at the second station, an individual sensor is aligned below each of the package positions in the bottom layer; and detecting with the sensors the presence or absence of the metallic lidstock through the secondary carton for each of the package positions.

2. The method of claim 1, wherein the secondary carton is transported to the first station, and then to the second station.

3. The method of claim 1, wherein the sensors comprise an inductive productivity sensor.

4. A method for confirming the presence of contact lens packages, each of the packages containing a contsct lens therein and enclosed with metallic lidstock, said method comprising:

stacking said packages one on top of one another in a secondary carton, wherein the secondary carton is designed to hold a predetermined number of packages in a vertically stacked arrangement; and positioning the secondary carton in an upright position beneath a sensor, and detecting with the sensor the presence or absence of metallic lidstock at a top position of the vertically stacked arrangement.

5. The method of claim 4, wherein the secondary carton holds a single vertically stacked arrangement of said packages.

6. The apparatus of claim 5, wherein the sensor comprises an inductive productivity sensor.

7. An apparatus comprising:

a conveyor that transports secondary cartons containing contact lens packages, said contact lens packages containing a contact lens therein and enclosed with metallic lidstock, and wherein the secondary carton includes a top layer of contact lens packages arranged above a bottom layer of contact lens packages, and each of the top and bottom layers includes a predetermined number and arrangement of package positions;

a first set of sensors arranged above the conveyor, the first set including individual sensors aligned with each of the package position in the top layer; and a second set of sensors arranged below the conveyor, the second set including individual sensors aligned with each of the package positions in the bottom layer, the sensors detecting the presence or absence of the metallic lidstock through the secondary carton for each respective package position.

8. The apparatus of claim 7, wherein the first set of sensors is located at a first station along the conveyor, and the second set of sensors is located at a second station along the conveyor, the first station being upstream of the second station.

* * * * *